United States Patent [19]

Girard et al.

[11] Patent Number: 4,927,196

[45] Date of Patent: May 22, 1990

[54] POWER-ASSISTED ROTARY BOLT LOCK

[75] Inventors: Joël Girard, Abbeville; Christian Wattebled, Sailly-Flibeaucourt, both of France

[73] Assignee: Vachette, Paris, France

[21] Appl. No.: 259,584

[22] Filed: Oct. 18, 1988

[30] Foreign Application Priority Data

Oct. 21, 1987 [FR] France ..... 87 14529
May 24, 1988 [FR] France ..... 88 06852

[51] Int. Cl.[5] ..... E05C 3/06

[52] U.S. Cl. ..... 292/201; 292/216; 292/DIG. 43

[58] Field of Search ..... 292/201, 216 X, 341.16, 292/DIG. 43 X

[56] References Cited

U.S. PATENT DOCUMENTS 3,332,713 7/1967 De Claire et al. .
3,695,659 10/1972 Gionet et al. ..... 292/216
4,544,189 10/1985 Fiordellisi et al. ..... 292/D43 X
4,597,598 7/1986 Bascou ..... 292/D43 X
4,624,491 11/1986 Vincent ..... 292/201
4,635,454 1/1987 Brown ..... 292/216 X
4,652,027 3/1987 Quantz ..... 292/201
4,746,153 5/1988 Compeau et al. ..... 292/D43 X
4,763,936 8/1988 Rogakos et al. ..... 292/216 X
4,796,932 1/1989 Tame ..... 292/201 X

FOREIGN PATENT DOCUMENTS 151633 9/1901 Fed. Rep. of Germany ..... 292/341.16

*Primary Examiner*—Gary L. Smith
*Assistant Examiner*—Michael J. Milano
*Attorney, Agent, or Firm*—Cushman, Darby & Cushman

[57] ABSTRACT

The lock (S), intended in particular for an automobile door, includes a rotary bolt (1) intended for cooperation with a keeper (2), and includes motive means arranged to assist at least the closure, as well as manual control means enabling the assurance of the opening and closure of the assisting motive means; it includes a transmission device (T) of the freewheel type (17), mounted in a recess (18) of the bolt (1) and arranged to communicate to the bolt a rotational movement originating in the assist means for the direction that corresponds to the closure of the lock (S); anti-lock means are arranged to be actuated by the manual control means, with a view to preventing the normal action of locking the freewheel (17), and uncoupling the bolt from the assist means in the event of failure of these means.

19 Claims, 4 Drawing Sheets

POWER-ASSISTED ROTARY BOLT LOCK

FIELD OF THE INVENTION

The invention relates to a lock including a rotary bolt intended for cooperation with a keeper, of the generic type including the following: motive means arranged to assist at least the locking; manual control means enabling the assurance of opening and closing in the case of failure of the assisting motive means; a transmission device arranged to transmit to the bolt a rotational movement originating in the assist means for the direction that corresponds to the closure of the lock, as well as anti-lock means arranged to be actuated by the manual control means in order to prevent the normal locking action of the transmission device and to disengage the bolt from the assist means in the event of a failure of these means.

Because this application appears to be most important, the invention relates in particular, but not exclusively, to a lock of this kind intended for a system for closing a door or similar part of an automobile, such as a door, tailgate, hatch, trunk lid, or hood.

BACKGROUND OF THE INVENTION

Locks of this kind operate very smoothly during closing and generally during opening, and have improved convenience. In fact, upon closing a door, hatch or the like, the user need merely manually move the door, or the like to approximately its closing position, and the assist means will automatically intervene and on their own will effect the closure of the door. These assist means are generally electrical.

The various embodiments of this type of lock proposed thus far, particularly in U.S. Pat. No. 3,332,713, are relatively complicated and bulky, especially in terms of the means making it possible to assure opening and closing in the event of failure of the assisting motive means.

SUMMARY OF THE INVENTION

The object of the invention is primarily to furnish a lock of the above-described type, which is simple and sturdy in construction and has reduced bulk, in particular in terms of the means for enabling opening and closing in the event of the failure of the assist means.

According to the invention, the transmission device of a lock of the above generic type is of the freewheel type and is mounted in a recess of the bolt, concentrically with the axis of rotation of this bolt.

The device of the freewheel type may include notches provided in the internal wall of the recess, and at least one pawl mounted on a rotor and arranged to cooperate with the notches; the pawl is elastically urged in the radially outward direction for engagement with a notch, and the rotor is wedged onto a shaft intended to be driven by the motive means.

The anti-lock means may include means for the retraction of the pawl or pawls which means include a plate mounted slidingly along the radial direction. The displacement of this plate is assured by the manual control means, and the plate is arranged to cooperate with at least one associated pawl to space it apart from the inside surface of the recess of the bolt, when the plate is displaced radially inward.

Mating means including a slot or inclined ramp, on the one hand, and a pin engaging the inside of this slot, on the other, are provided to assure the radial displacement of the plate.

Preferably, the pin is integral with a part mounted for rotation coaxially with the bolt and its rotation is obtained by action upon the manual control means, while the inclined slot engaged on the inside by the pin is provided in the plate, the unit being such that the rotation of the part in a suitable direction brings about the radial displacement of the plate toward the interior and frees the associated pawl from the notch of the internal recess.

Advantageously, assisting motive means include a nonreversible electric geared motor, the rotor of the transmission device of the freewheel type being connected for rotation with the output shaft of this geared motor.

The manual control means include a pushbutton intended so that in the course of its being pushed in, it first controls a switch intended for starting up the assisting motive means and then, as its course of being pushed in continues, controls the manual control of the opening.

Sometimes it may happen that an obstacle prevents the complete closure of the door, which is a particular hindrance in the case where the assisting motive means intervene, because they may induce major forces capable of causing damage to the obstacle impeding the closure. An obstacle of this kind may involuntarily be someone's finger or hand, or luggage.

To reduce the risks to a minimum in the case of an obstacle wedged in the door when the door is closed, the lock includes means sensitive to the force of resistance to closure, arranged to act upon the anti-locking means and/or the assist means to stop the assisted closing movement when the force of resistance exceeds a predetermined value.

Preferably, the means sensitive to the force of resistance are provided for action upon a limited zone, at the beginning of the closure.

Advantageously, the means sensitive to the force of resistance include an elastically urged disconnecting pin, arranged to establish a rotational connection between the bolt driven by the assist means, and an auxiliary part arranged to transmit the force between the bolt and the keeper. Preferably, the disconnecting pin is oriented substantially radially and is pushed in the direction of the center by a spring, this pin including a frustoconical head turned radially toward the interior arranged to cooperate with a V notch provided on the periphery of the auxiliary part mounted for rotation coaxially with the bolt, the pin being carried by the bolt and being capable of sliding radially.

The auxiliary part has the shape of a ring and includes an arm extending radially toward the outside, arranged to project into a slot of the bolt, intended to receive the keeper, the closing force being transmitted to the keeper by said arm. The bolt includes a protuberance located behind the arm of the ring, along the direction of rotation corresponding to the closure, an angular spacing existing between the faces facing the arm and the protuberance, when the disconnecting pin is engaged in the notch of the auxiliary part, this angular spacing vanishing and the protuberance coming to a stop against the arm when the disconnecting pin emerges from the notch of the auxiliary part.

When the anti-lock means include a plate mounted to slide substantially in the radial direction and rotationally immobilized, and the plate includes an edge which comes to cover the trajectory of the outer end of the disconnecting pin, the unit being such that when the pin leaves the notch of the auxiliary part, its opposite end pushes back the edge of the plate, which is thus displaced translationally and controls the unlocking of the free wheel.

The edge of the plate covers the trajectory of the end of the disconnecting pin over a limited angular extension corresponding for example to a course of approximately 10 mm of the keeper, at the beginning of the closure.

According to another possibility, a changeover switch is provided including a changeover contact arranged to be controlled by the radial displacement of said plate or of the disconnecting pin, this changeover contact controlling the reversal of the direction of rotation of the assisting motive means. Advantageously, the triggering threshold of the means sensitive to the force of resistance to the closure corresponds to a force on the order of 10 daN at the lever of the force on the keeper.

Preferably, the lock is arranged in such a manner that the disengagement or disconnection is possible only substantially over the first half of the course of closing.

The invention, based on the above arrangements, comprises a certain number of other arrangements which will be described in further detail below, in terms of an exemplary embodiment described in conjunction with the accompanying drawings, but this example is understood to be in no way limiting.

DESCRIPTION OF THE PREFERRED EMBODIMENT

Figure 1:
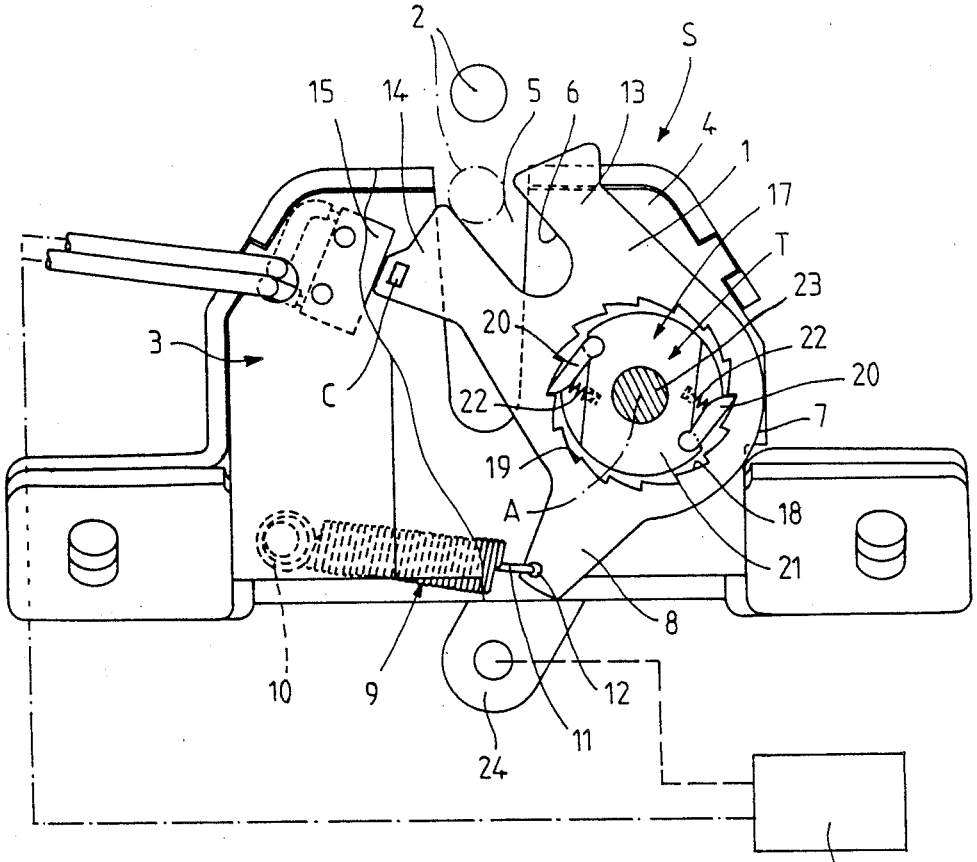
FIG. 1 is a view along the line I—I of FIG. 2, with portions omitted, of principle elements of a lock according to the invention.

Turning now to FIG. 1 of the drawings, a lock S is seen, including a rotary bolt 1 arranged to cooperate with a keeper 2. The lock S is intended for a system for closing a door or lid of an automobile. More particularly, for the example shown in the drawings, it relates to a trunk lid, tailgate or hatch, which pivots about a horizontal axis oriented transversely with respect to the mean longitudinal direction of the vehicle. The lock S includes a base 3 intended for being fixed to the body of the vehicle and being immobile with respect to this body. The keeper 2 may include a cylindrical rod having a transverse portion, provided on and movable with the trunk lid, hatch or tailgate. In FIG. 1, the keeper 2 accordingly describes a circular motion about an axis located on the left of this FIG. 1. In the portion corresponding to this FIG. 1, the trajectory of the keeper 2 is substantially at a tangent to a vertical, and the movement of the keeper 2 in the vicinity of the lock S is substantially a rectilinear vertical movement from top to bottom, upon the closure, and from bottom to top upon opening.

The base 3 may form a kind of case including two parallel side walls 4 between which the bolt 1 is mounted. Each wall 4 includes a curved cut 5, the mean direction of which is that of the movement of the keeper 2 in the vicinity of the lock S. In the exemplary embodiment of FIG. 1, the mean direction of the curved cuts 5 is vertical, these cuts being open on the side of the keeper 2.

The bolt 1 is formed of a flat part the contour of which, visible in FIG. 1, has two elongated substantially parallel opposed edges. The bolt 1 is mounted for rotation about a geometrical axis A located on one side of the cut 5, in the example of FIG. 1 on the right-hand side. The end of the bolt 1 intended for cooperation with the keeper 2 includes a slot 6, limited by two edges parallel to the mean longitudinal direction of the bolt 1, and opening toward the short side of this bolt turned toward the keeper 2. In the opening position of the lock, the mean direction of this slot 6 is inclined with respect to the mean direction of the cut 5, and the opening of this slot 6 is located in the opening of the cut 5 in such a manner that when the keeper 2 enters into the cut 5, the keeper likewise penetrates the slot 6.

The end 7 of the bolt opposite the slot 6 may have a rounded shape, substantially in a semicircle. In the zone of connection of this end 7 and one long side of the bolt, a radial extension 8 projecting toward the bottom, in the exemplary embodiment of FIG. 1, is provided. The outer end of this extension 8 is connected to elastic means 9 for returning the bolt to the opening position. These return means 9 are advantageously embodied by a traction spring, one end 10 of which is fastened to the base 3, while the other end 11 of this spring is fastened to a hole 12 provided toward the radial outer end of the extension 8.

The slot 6 is defined by two branches 13, 14 in the bolt 1, the branches located respectively on the right and left of the mean direction of the slot 6, as seen in FIG. 1. Arbitrarily, the branch 14 comprises the lower branch, the one engaging the base 3 to the greatest extent. A contact sensor 15 sensitive to the passage of a magnet C is carried by the branch 14, for example a Reed contact, is mounted in the base 3. In the open position of the lock, as shown in FIG. 1, the magnet C is located in the vicinity of the contact 15, which is in a first state. Upon closure of the lock, the bolt 1 rotates counterclockwise, as viewed in FIG. 1, and the end of the branch 14 moves away from the contact 15, which changes its state, for example shifting from the open position to the closed position.

The contact 15 is arranged to control assisting motive means 16, optionally via a relay. These motive means 16 are mechanically connected to the bolt 1 by a kinematic chain, shown schematically, in order to assist at least the closure of the lock by driving the bolt 1 in the direction desired, that is, in the counterclockwise direction. Upon the opening, the motive means 16 are started up in the opposite direction, for example by the action of a key or pushbutton, which under the influence of the elastic return means 9 allows the bolt to rotate in the opening direction, that is, in the clockwise direction is viewed in FIG. 1.

The lock S includes a transmission device T of the freewheel type, arranged for transmitting to the bolt 1 a rotational movement originating in the assist means 16 for the direction that corresponds to the closure of the lock, that is, for the counterclockwise direction as viewed in FIG. 1, and also includes anti-lock means L (see FIGS. 2 and 3) arranged to be actuated by manual control means M in order to prevent the normal action of locking the freewheel 17 and the uncoupling of the bolt 1 from the assist means 16 in the event of failure of the assist means.

Advantageously, the freewheel 17 is mounted in a recess 18 of the bolt 1 concentric with the axis of rotation A of this bolt. The freewheel 17 includes notches 19 provided on the inside wall of the recess lB and two pawls 20 which are diametrically opposed and mounted on a rotor 21 mounted for rotation on the wall 4 of the base 3, coaxially with the bolt 1. Each pawl 20 is articulated at one end on the rotor 21 and each is urged by elastic return means 22 in the radially outward direction, so that with its other end it engages a notch 19. The rotor 21 is wedged onto a shaft 23 that projects outside the base 3 (see FIG. 2) and is secured for rotation with a lever 24, the angular displacements of which are controlled by the assist means 16.

Figure 3:
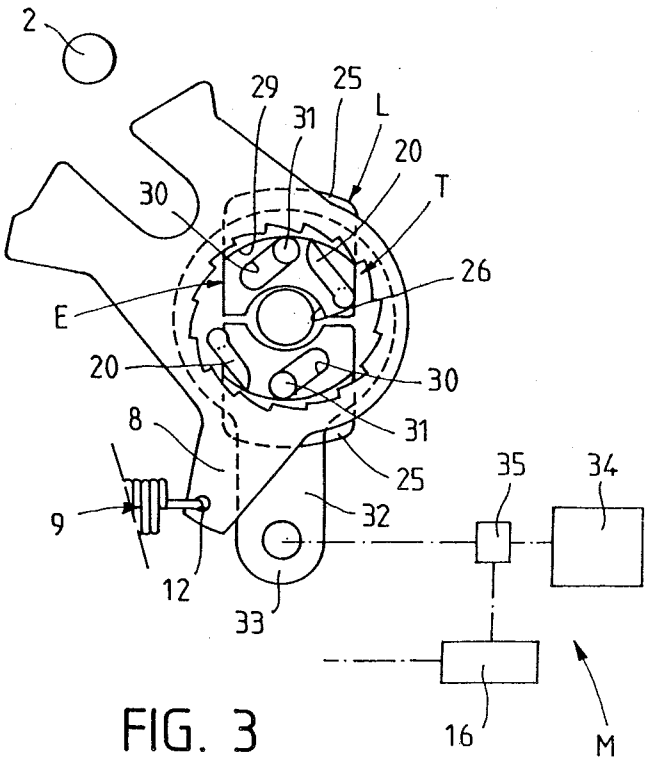
FIG. 3 is a view taken along the line III—III of FIG. 2 of principle parts of the lock, when the manual control means are actuated to bring about manual opening, this view being folded down in the reverse direction of the arrows III.

The anti-lock means L include means E for retracting the pawls 20. The means E include one plate 25 (see FIGS. 2 and 3) for each pawl, mounted to slide along the radial direction. Each of the two diametrically opposed plates 25 has a substantially rectangular contour, as can be seen in FIG. 3, the side of each plate turned toward the shaft 23 having a cut 26 in the shape of a circular arc. The zone 27 of the plate 25 located radially toward the outside has a greater thickness, as can be seen in FIG. 2, such as to protrude transversely on the side of the bolt 1 by a distance h with respect to the remainder of the plate.

Figure 2:
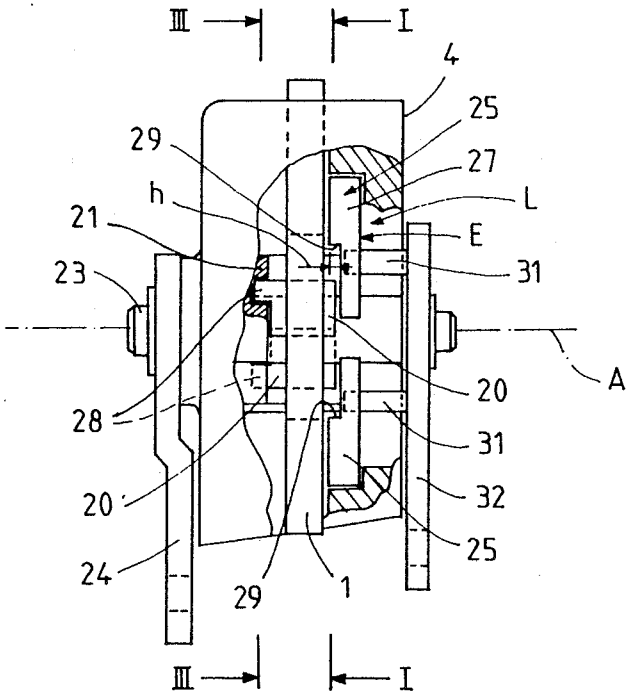
FIG. 2 is a view from the left with respect to FIG. 1, with portions omitted or removed.

Each pawl 20, as can be seen in FIG. 2, includes a transverse extension 28 forming a hinge pin in an opening in the base 3, on the side of the bolt 1 opposite that where the plates 25 are located. The dimension of the pawl 20 in a direction parallel to the axis A is greater than the thickness of the bolt 1, such that the pawl 20 is capable of projecting beyond the face of the bolt 1 turned toward the plates 25, as shown in FIG. 2.

An edge 29 in the form of an arc of a circle is formed on the inside face of each plate 25 at the level of the connection with the thickest portion 27. This edge 29 is located radially outward of the pawls 20. The entire unit is arranged such that the edge 29 comes to cooperate with the portion of the pawl 20 projecting with respect to the bolt 1 when the associated plate 25 is displaced radially inward, such that the pawl 20 is pushed back toward the axis A counter to the elastic return means and hence is disengaged from the notches 19.

The displacement of each plate 25 is assured, originating in manual control means M, with the aid of mating means that for each plate 25 include one slot or ramp 30 inclined with respect to the radial direction and one pin 31 engaging the inside of this slot 30. Preferably, the pin 31 is integral with a part 32 acting as a lever and mounted for coaxial rotation with the bolt 1. Two pins 31 are provided, diametrically opposed to one another, for cooperating respectively with the slot 30 provided in each plate 25. The rotation of the part 32 is obtained by action upon the manual control means M, which exert a push or pull upon the radial end 33 of this part 32. In the view shown in FIG. 3, the clockwise rotation of the part 32, because of the inclination selected for the slots 30, causes a radial displacement toward the interior of the two plates 25 and hence the retraction of the pawls 20.

The assisting motive means 16 may comprise a reversible electric geared motor, the output shaft of which is connected for rotation to the shaft 23 and the rotor 21. Locking of the bolt 1 in the closing position is obtained by the stoppage of the geared motor 16; the engagement of the pawls 20 with the notches 19 prevents a rotation of the bolt, since the shaft 23 is immovable.

The manual control means M may include a pushbutton 34 or the equivalent, intended so that in the course of its being pushed in, it first controls a switch 35 intended for starting up the assisting motive means 16 and then, as its course of being pushed in continues, controls the manual control of the opening.

This being the case, the functioning of a lock according to the invention is as follows.

First, its manual function will be described, assuming that the assist means 16 are inoperative. Under these conditions, the shaft 23 and the rotor 21 of the freewheel 17 are rotationally locked.

The closure of the trunk lid is obtained in the usual manner by slamming the door in the direction of closure. As viewed in FIG. 1, the keeper 2 displaces from top to bottom, to enter into the cut 5 and the slot 6.

Coming to cooperate with the lower edge of the slot 6, the keeper drives the bolt 1 to rotate counterclockwise, which is possible because for this direction of rotation of the bolt 1 with respect to the immovable rotor 21, the pawls 20 do not exert a locking action and are retracted from the passage of the notches 19.

The movement continues until the position of total closure with successive latchings of the pawls 20, which oppose a rotational movement in the opposite direction, that is, in the clockwise direction, of the bolt 1.

When the position of total closure is attained, the bolt 1 is locked in this position by the pawls 20, because of the immobilization of the rotor 21, by the stoppage of the motive means 16.

Manual opening is obtained by acting upon the manual means M and more particularly upon the part acting as a lever 32 (FIG. 3), via the pushbutton 34. In the view shown in FIG. 3, the action of opening upon the pushbutton 34, by the complete depression of this pushbutton, brings about the rotation of the lever 32 in the clockwise direction. The cooperation of the pins 31 and slots 30 causes the displacement of the plates 25 radially toward the inside, until the extreme position shown in FIG. 3. The edges 29 of the plates 25 (see FIG. 2) come to cooperate with the pawls 20 and displace these pawls toward the inside, thereby moving them away from the notches 19.

The bolt 1 is now rotationally freed and begins to turn in the direction of opening (that is, the clockwise direction as shown in the drawings), under the action of the return spring 9. The keeper 2 is freed, and the door can be opened.

The closure and opening of the lock in the case where the assisting motive means 16 are in a functional state will now be described.

For the closure of the door, the keeper 2 always effects the vertical movement from top to bottom as seen in FIG. 1, because of the manual action of the user upon the door. The entry of the keeper 2 into the slot 6 brings about the beginning of the rotational movement of the bolt 1 in the counterclockwise direction.

The contact 15, because of its remoteness from the branch 14, changes its state and causes the startup of the geared motor 16, which drives the lever 24 counterclockwise in the view of FIG. 1. The shaft 23 and the rotor 21 are driven in the same direction, which corresponds to the locking of the pawls 20 in the notches 19 and hence to the locking of the freewheel 17, which transmits the rotational movement to the bolt 1.

The closure movement continues automatically until the bolt 1 attains the position of total closure, at which an end-of-course contact (not shown) effects the stoppage of the geared motor 16.

For the opening of the door, a signal of rotation in the opposite direction is sent to the geared motor 16. This signal may be obtained, as explained above, by the closure of a contact 35 obtained at the beginning of the course of the pushbutton 34. In a variant, this signal could be furnished by the action of a key in the lock.

Because of this reversed rotation of the geared motor 16, the rotor 21 begins to turn clockwise in the view of FIG. 1, and the pawls 20 retract from the passage of each notch 19. The bolt 1 is now capable, by the action of the return spring, of effecting a clockwise rotational motion, at a speed equal at least to that of the rotor 21.

The keeper 2 is freed when the rotation has attained a sufficient amplitude.

Figure 5:
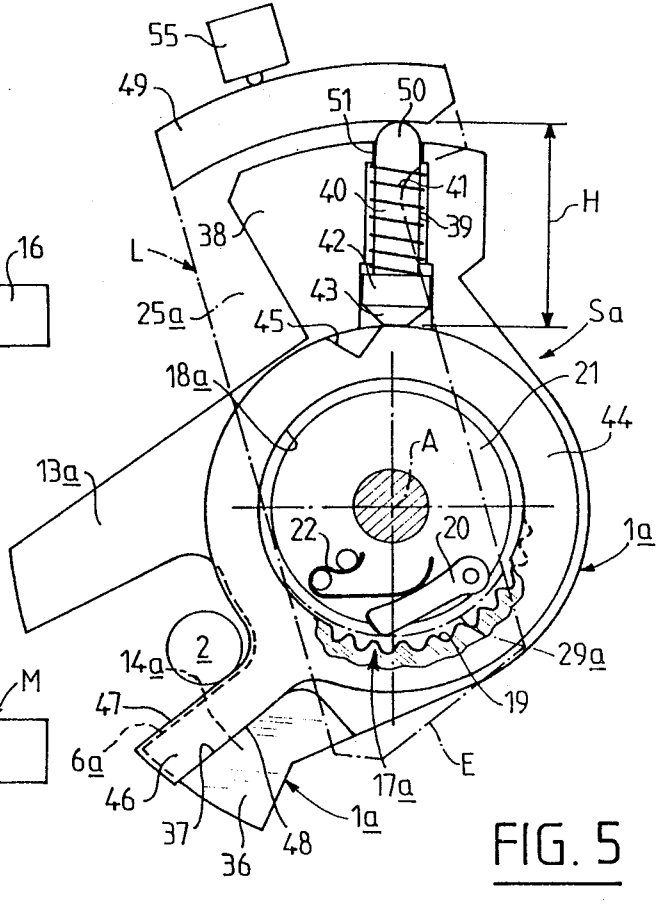
FIG. 5 shows the lock in the disconnected position.
Figure 4:
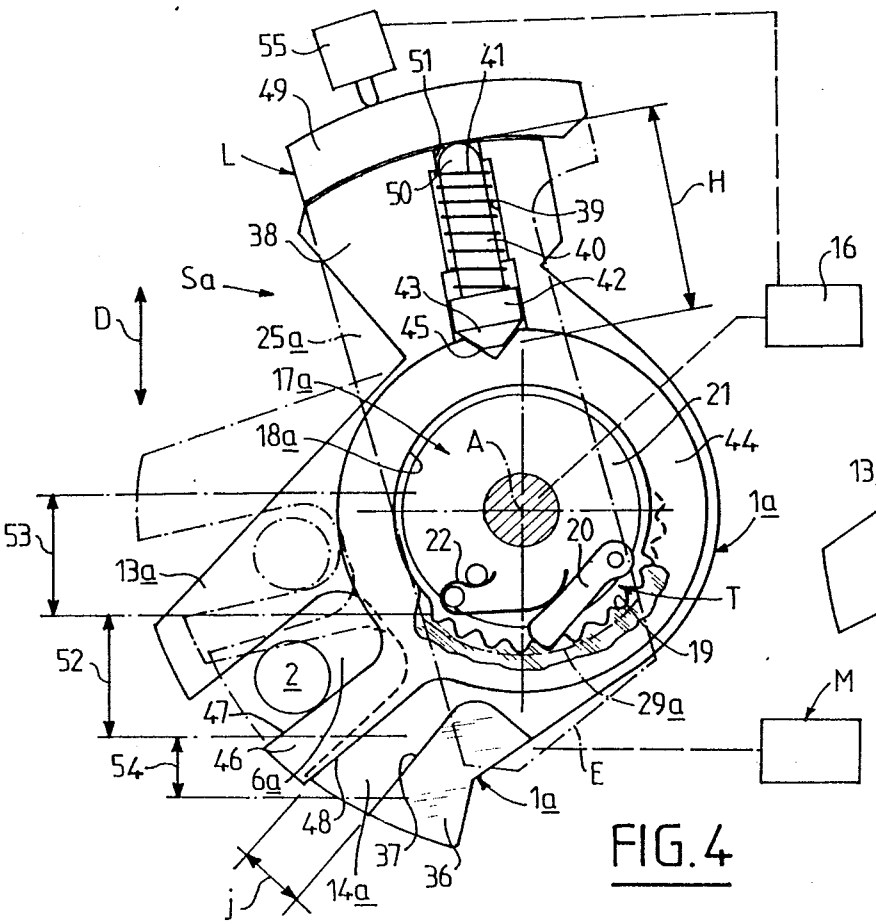
FIG. 4 is a simplified view of a lock with a disconnecting pin at the beginning of the closure, upon manual approach.
Figure 6:
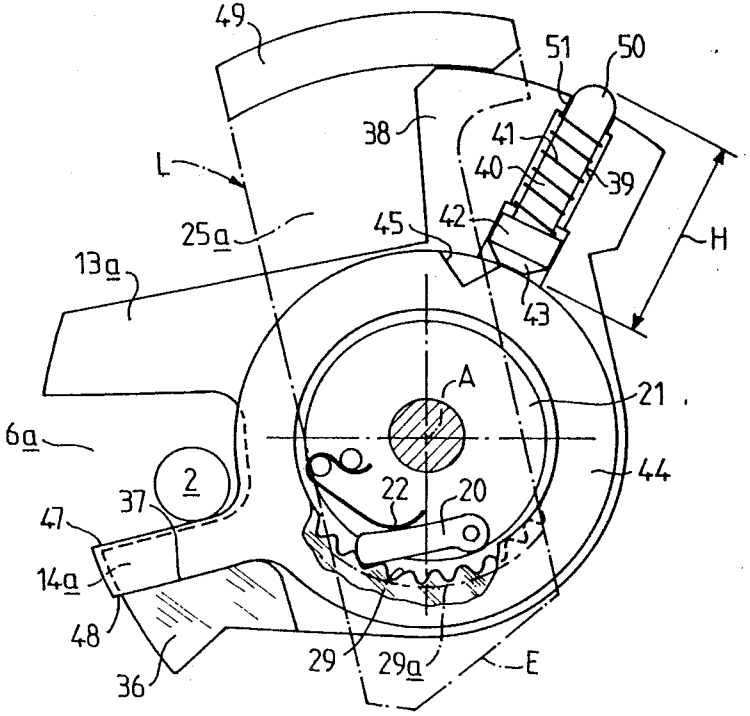
FIG. 6 shows the lock at the end of the closure.

Turning now to FIGS. 4–6 of the drawings, a variant embodiment can be seen that permits a disconnection in the case of an obstacle impeding the closure. Elements identical to or playing similar roles to those of the elements described above are designated by the same reference numerals, optionally followed by the letter a, and need not be described again here.

The bolt 1*a* and the keeper 2 are shown respectively on each of the parts intended to be locked with respect to one another when the lock is closed. For example, in the case of an automobile door, the keeper is generally mounted on a fixed part of the door frame, while the bolt is mounted on the edge of the door itself; a reverse arrangement would also be possible. In any manner, upon opening or closing, the keeper 2 effects a relative movement with respect to the axis A of rotation of the bolt, which movement can be likened to a translational movement along a direction D substantially orthogonal to the axis A.

In FIGS. 4–6, upon the closure, the keeper 2 displaces from bottom to top with respect to the axis A, and the bolt 1*a* rotates clockwise for closure. A reverse motion is produced upon opening.

On one of its flat lateral faces, the bolt includes a boss 36 located to the rear, in the direction of rotation corresponding to closure, of the slot 6*a*. In the example in question, the direction of rotation being clockwise and the slot 6*a* being oriented toward the bottom, the boss 36, located on the face of the bolt that can be seen in FIG. 4, is located in the lower portion of the bolt. The front face 37 of this boss 36 is flat and substantially parallel to the direction of the radius passing through the center of the slot 6*a*. This slot is defined by two branches 13*a*, 14*a* in the bolt 1*a*.

In a peripheral zone located substantially spaced from the slot 6*a*, the bolt 1*a* includes a radial extension 38 provided with a radial seat 39 in which a disconnecting pin 40 is mounted. This pin is urged elastically, by a compression spring 41, radially toward the interior. The spring 41 is supported, at its end located radially outward, on a transverse shoulder of the seat 39 and at its opposite end on a transverse shoulder defined by a cylindrical member 42 of greater diameter of the pin 40. This member 42 is extended radially toward the interior by a frustoconical head 43.

An auxiliary part 44 mounted for rotation about the axis A as well is secured for rotation with the bolt 1*a* via the pin 40. This part 44 has the shape of a ring concentric with the bolt, and on its periphery it has a notch 45 in the form of a V opening toward the outside and arranged to receive the head 43 when the axis of the pin 40 is located in the plane bisecting the notch 45.

On the periphery, space from the notch 45, the part 44 includes an arm 46 projecting radially toward the outside and arranged to be located in the slot 6*a* when the head 43 engages the notch 45. The edge 47 of this arm 46 is located toward the front, in the direction of closure of the lock, and is located forward of the rear edge of the slot 6*a*; when the bolt 1*a* is driven for clockwise rotation, the head 43 is located in the notch 45. It is the edge 47 of the arm 46 that comes into contact with the keeper 2.

The rear edge 48 of the arm 46 is spaced apart by an angular distance j from the forward face 37 of the boss 36 when the head 43 is located in the notch 45. If the part 44 comes to turn counterclockwise with respect to the bolt 1*a*, then the rear edge 48 comes to a stop against the face 37 (see FIG. 5).

The freewheel 17*a* is mounted in a recess 18*a* of the bolt 1*a*, concentric with the axis of rotation A. The freewheel 17*a* includes notches 19*a* provided on the inside wall of the recess 18*a*, and at least one pawl 20 mounted on a rotor 21 capable of being driven in rotation, by the means 16, coaxially with the bolt 1*a*. The pawl 20, or each pawl 20, is articulated at one end on the rotor 21 and is urged by elastic return means 22 in the radially outward direction, so that with its other end it engages a notch 19.

The means E include a plate 25*a* mounted for sliding radially, but locked rotationally. The plate 25*a* includes an edge 49 extending along an arc of a circle centered on the axis A and located in the vicinity of the outer peripheral limit of the extension 38. On the opposite end, the plate 25*a* includes another edge 29*a*, in the form of an arc of a circle, arranged to cooperate, upon a radial displacement of the plate 25*a*, with a lateral projecting portion of the pawl 20 on the side opposite the ring 44.

The displacement of the plate 25*a* for disconnecting the pawl 20 from the notches 19 must take place upward in the view shown in FIGS. 4–6. This displacement may be assured by the manual control means M.

This displacement may also be assured by the rounded end 50 of the pin 40 opposite the head 43, when this head leaves the notch 45. The seat 39 opens out radially outward via an opening 51 arranged to allow the end 50 to pass by it, while the length H of the pin 40 is provided so that the pin cannot project with its end 50 past the radially outer edge of the extension 38, when the head 43 is seated in the recess 45. Contrarily, when the head 43 has left this recess and is supported against the outer periphery of the ring 44 (see FIG. 5), the end 50 projects past the edge of the extension 38, and in cooperation with the edge 49 pushes the plate 25*a* back and disconnects the pawl 20 from the notches 19 of the bolt.

The angular extent of the edge 49 is such that the end 50 of the pin 40 can cooperate with this edge 49 for the beginning of the closure course of the lock. In FIG. 4, the zone of the relative positions of the center of the keeper 2 at which a disconnection is possible has been shown at 52; that is, this is the zone for which the end 50 can act counter to the edge 49. For the zone 53, which corresponds to the end of the closure movement, located on the far side of the zone 52, the pin 40 is located on beyond the side of the edge 49, such that the end 50 cannot push the edge 49 back, as can be seen in FIG. 6.

The zone 54 of the relative positions of the center of the keeper 2, shown in FIG. 4, corresponds to the manual operation and to the entry of the keeper 2 into the slot 6a of the bolt.

A changeover contact 55 is advantageously provided, arranged to be controlled by the departure of the pin 40 from the recess 45 in the disconnection zone 52. This contact 55 may be disposed in such a manner as to be controlled by the displacement of the plate 25a; for example, the contact 55 includes a pusher located facing the outer face of the edge 49, the pusher of the contact 55 being depressed when the plate 25a is displaced upward. The contact 55 is combined with a control logic in such a manner as to control the reversal of the direction of rotation of the assisting motive means and hence the reversal of the direction of rotation of the rotor 21

When the reversal of the direction of rotation is directed, the rotor 21 begins to turn counterclockwise, and the pawl 20 draws away from the passage of the notches 19, leaving the bolt 1a free to rotate counterclockwise.

Contact means (not shown) sensitive to the position of the bolt are provided for putting the assist means 16 into operation when after a manual approach the bolt 1a has rotated in the closing direction by a relatively small predetermined angle.

This being the case, the functioning of the lock of FIG. 4 is as follows.

First considering the operation of closure, the bolt 1a is initially in the opening position.

The door to be closed is manually moved toward its closed position, and the keeper 2 enters into the space limited by the forward edge of the slot 6a and the rear edge 47 of the arm 46.

The corresponding manual approach to the zone 54, by cooperation of the keeper 2 and the forward edge of the slot 6a, causes the clockwise rotation of the bolt 1a, and the ring 44 remains connected to the bolt by the head 43 engaging the notch 45. In the course of this approach phase, no notable torque whatever needs to be transmitted from the bolt 1a to the ring 44, such that there is no reason whatever for the head 43 to leave the notch 45.

At the end of the zone 54, the rotation of the bolt 1a is sufficient to control a switch for starting up the assisting motor 16, such that the rotor 21 comes to be driven in clockwise rotation, and to transmit this motion to the bolt 1a by the cooperation of the pawl 20 with the notches 19 provided on the bolt.

As a result, the forward edge of the slot 6a moves out of contact with the keeper 2, which comes into contact with the forward edge 47 of the arm 46.

Hence a torque is transmitted from the rotor 21 to the bolt 1a by the pawl 20, which braces itself firmly, and from the bolt 1a to the auxiliary part 44 by way of the disconnecting pin 40, the head 43 of which engages the notch 45. A closure force is transmitted by the arm 46 to the keeper 2 upon contact.

If a resistance to closure greater than that authorized by the spring 41 of the disconnecting pin 40 and its spring 41 should manifest itself in the zone 52, then the head 43 leaves the seat 45 under the ramp effect of the inclined surfaces of the notch, compressing the spring 41. Disconnection takes place between the bolt 1a and the ring 44. The ring 44 and the arm 46 stop rotating clockwise. The displacement of the pin 40 comes about in the angular zone where the edge 49 covers the end 50, this end pushing the edge 49 back toward the outside and displacing the plate 25a which lifts the pawl 20. The end of this pawl 20 no longer cooperates with the notches 19, and the bolt 1a is no longer subjected to a torque originating in the rotor 21.

If a changeover contact 55 is provided, the rotor 21 starts to rotate in the opposite direction, which likewise suppresses any torque in the clockwise direction upon the bolt 1a. On this operation, it is unnecessary to raise the pawl 20, and the lower edge 29a of the plate 25a may be omitted. This solution has the advantage of making it unnecessary to dull the end of the pawl 20 that cooperates with the teeth 19, as well as to dull the end of these teeth. In fact, when the plate 25a is displaced to lift the pawl 20, a relatively major force is developed between this pawl 20 and the bolt 1a, because a resistance to the closure manifests itself. The reversal of the direction of rotation prevents relatively major friction and shock.

In any manner, in the event that a person's finger or luggage should become wedged in the door during closure, the lock according to FIG. 4 makes it possible to obtain a disconnection that stops the action of the assisting motive means, which prevents damage that would be difficult to repair.

Should no obstacle manifest itself in the first portion of the closure course of the door or lid, then the pin 40 passes beyond the angular zone corresponding to the edge 49.

At the end of the closure, the force developed, especially because of the reaction of the joints, is greater than the threshold of triggering of the disconnecting pin 40 and its spring 41, so that the head 43 leaves the recess 45. However, since the end 50 can no longer act on the edge 49, the assistance continues, and the bolt 1a continues to be driven in rotation by the pawl 20, while the arm 46 and the keeper 2 are stopped.

Under these conditions, the distance j (FIG. 4) between the rear edge 48 of the arm 46 and the face 37 of the boss 36 disappears, and this face 37 comes to rest against the edge 48 (see FIGS. 5 and 6).

The torque is then transmitted from the bolt 1a to the arm 46 by this boss 36. A closure force is accordingly transmitted by this arm 46 to the keeper 2.

The unit is preferably arranged, in particular as concerns the force of the spring 41 and the inclination of the faces 45, in such a manner that the disconnection is produced for a force at the level of the keeper 2 of approximately 10 daN, while the force of closure at the end of the closure is on the order of 50 daN.

The disconnection zone 52 corresponds substantially to the first half of the closure path, while the zone 53 corresponds to the second half.

At the level of the keeper 2, for one complete closure course approximately 25 mm long, the manual approach (zone 54) corresponds to 5 mm, for example, while the zone 52 corresponds to 10 mm and the zone 53 also corresponds to 10 mm.

Figure 7:
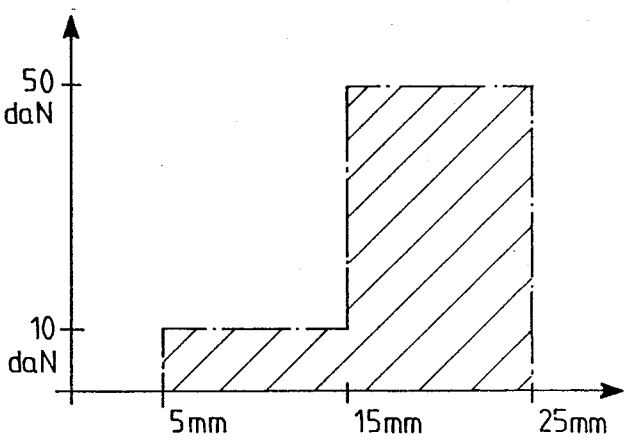
FIG. 7 is a diagram showing the forces brought into play upon closure of the lock of FIGS. 4–6, these forces being plotted on the ordinate, as a function of the relative course between the keeper and the bolt, which is plotted on the abscissa.

The diagram of the force, expressed in daN, and plotted on the ordinate is given in FIG. 7, as a function of the course of the keeper, expressed in millimeters and plotted on the abscissa.

A lock according to the invention is simple and sturdy and not very bulky, because of the seating of the freewheel in the bolt. It will be appreciated that other types of freewheel than that described in the exemplary embodiment herein may also be suitable.

A lock of this type is applicable to any system for closing an automobile door, hood, trunk lid, tailgate or hatch. Protection in the event an obstacle is encountered during the closure can be assured in a simple manner and with little bulk.

What is claimed is:

1. A lock device of the type used with an automobile door, lid or trunk or the like, comprising a rotary bolt means for cooperation with a keeper, motor assist means for assisting rotation of said bolt means at least during locking movement of the locking device, manual control means for operating said bolt means, said manual control means being operable in the event of failure of said motor assist means, transmission means operatively connected to said motor assist means for imparting rotation to said bolt means in a locking direction, said manual control means including an anti-locking device for preventing operation of said transmission means to thereby disengage said bolt means from said motor assist means in the event of failure of said motor assist means, said transmission means comprising a free wheel rotatably mounted adjacent said bolt means concentrically therewith and having means for rotatably driving said bolt means.

2. A lock device of the type used with an automobile door, lid or trunk or the like, comprising a rotary bolt means for cooperation with a keeper, motor assist means for assisting rotation of said bolt means at least during locking movement of the locking device, manual control means for operating said bolt means, said manual control means being operable in the event of failure of said motor assist means, transmission means operatively connected to said motor assist means for imparting rotation to said bolt means in a locking direction, said manual control means including an anti-locking device for preventing operation of said transmission means to thereby disengage said bolt means from said motor assist means in the event of failure of said motor assist means, said transmission means comprising a free wheel rotatably mounted adjacent said bolt means concentrically therewith and having means for rotatably driving said bolt means, said bolt means including a central recess and said free wheel being disposed in said recess, said recess having a perimeter provided with notches and said free wheel having at least one pawl means carried therein and movable into and out of engagement with one of said notches, said free wheel having elastic means for urging said one pawl into engagement with a said one of said notches, said free wheel being connected to a drive shaft with said motor assist means being provided for driving said drive shaft.

3. A lock device as defined by claim 2, wherein said anti-lock means include means for retracting the pawl.

4. A lock device as defined by claim 3, wherein said means for retracting the pawl include a plate mounted for sliding along a radial direction with respect to said shaft, the displacement of said plate being effected by said manual control means, the plate being arranged to cooperate with said pawl to space it apart from said notches of said recess of the bolt means, when said plate is displaced radially toward said shaft.

5. A lock device as defined by claim 4, wherein mating means including an inclined slot, on the one hand, and a pin engaging said slot, on the other, are provided to effect the radial displacement of the plate.

6. A lock device as defined by claim 5, wherein the pin is integral with a part mounted for rotation coaxially with the bolt means the rotation of which is obtained by the manual control means, while the inclined slot engaged on the inside by the pin is provided in the plate, the unit being such that the rotation of the part in a suitable direction brings about the radial displacement of the plate toward the shaft and frees the associated pawl from the notch of the recess.

7. A lock device as defined by claim 1, wherein the motor assist means include a reversible electric geared motor, the free wheel of the transmission device being connected for rotation with the output shaft of this geared motor.

8. A lock device as defined by claim 1, wherein the manual control means include a pushbutton intended so that in the course of its being pushed in, said pushbutton first controls a switch for starting up the motor assist means and then, as the pushing in continues, controls the manual control of the opening.

9. A lock device as defined by claim 1, wherein said device includes means sensitive to a force of resistance to the closing for cooperation with the anti-locking means and the motor assist means to stop the assisted closing movement when the force of resistance exceeds a predetermined value.

10. A lock device as defined by claim 2, wherein said device includes means sensitive to a force of resistance to the closing for cooperation with the anti-locking means and the motor assist means to stop the assisted closing movement when the force of resistance exceeds a predetermined value.

11. A lock device as defined by claim 10, wherein said means sensitive to the force of resistance are provided for action in a limited zone, at the beginning of the closure.

12. A lock device as defined by claim 10 or 11, wherein the means sensitive to the force of resistance include a disconnecting pin, elastically urged, arranged to establish a rotational connection between the bolt means driven by the motor assist means, and an auxiliary part arranged to transmit the force between the bolt means and the keeper.

13. A lock device as defined by claim 11, wherein the disconnecting pin is oriented substantially radially with respect to said drive shaft and is pushed in the direction of the drive shaft by a spring, the pin including a frustoconical head facing radially toward said shaft and arranged to cooperate with a V notch provided on the periphery of the auxiliary part mounted for rotation coaxially with the bolt means, the pin being carried by the bolt means and being capable of sliding radially with respect to said drive shaft.

14. A lock device as defined by claim 12, wherein the auxiliary part has the shape of a ring and includes an arm extending radially outwardly, arranged to project into a slot of the bolt means, intended to receive the keeper, the closing force being transmitted to the keeper by said arm.

15. A lock device as defined by one of the claim 14, wherein the bolt means includes a protuberance located behind the arm of the ring, an angular spacing existing between opposed faces of the arm and the protuberance, when the disconnecting pin is engaged in the notch of the auxiliary part, this angular spacing vanishing and the protuberance coming to a stop against the arm when the disconnecting pin leaves the notch of the auxiliary part.

16. A lock device as defined in claim 14, wherein the anti-locking means include a plate mounted to slide substantially in the radial direction and held against rotation, said plate including an edge which comes to cover the trajectory of the outer end of the disconnecting pin, the unit being such that when the pin leaves the notch of the auxiliary part, its opposite end pushes against said edge of said plate, which plate is thus displaced translationally and controls the unlocking of the free wheel.

17. A lock device as defined by claim 16, wherein the edge of the plate covers the trajectory of the end of the disconnecting pin over a limited angular extension at the beginning of the closure of the keeper.

18. A lock device as defined in claim 16, wherein said device includes a changeover contact arranged to be controlled by the radial displacement of one of said plate and of the disconnecting pin, said changeover contact controlling the reversal of the direction of rotation of the motor assist means.

19. A lock device as defined by claim 17 wherein the plate has dimensions such that the disengagement or disconnection is possible only substantially over the first half of the course of closing of the keeper.

* * * * *